US011658019B2

(12) United States Patent
Jordan

(10) Patent No.: US 11,658,019 B2
(45) Date of Patent: May 23, 2023

(54) IMR-MS REACTION CHAMBER

(71) Applicant: IONICON ANALYTIK GESELLSCHAFT M.B.H., Innsbruck (AT)

(72) Inventor: Alfons Jordan, Innsbruck (AT)

(73) Assignee: IONICON ANALYTIK GESELLSCHAFT M.B.H., Innsbruck (AT)

( * ) Notice: Subject to any disclaimer, the term of this patent is extended or adjusted under 35 U.S.C. 154(b) by 114 days.

(21) Appl. No.: 17/046,113

(22) PCT Filed: Sep. 27, 2019

(86) PCT No.: PCT/EP2019/076191
§ 371 (c)(1),
(2) Date: Oct. 8, 2020

(87) PCT Pub. No.: WO2020/065012
PCT Pub. Date: Apr. 2, 2020

(65) Prior Publication Data

US 2021/0057203 A1 Feb. 25, 2021

(30) Foreign Application Priority Data

Sep. 28, 2018 (EP) ..... 18197501

(51) Int. Cl.
*H01J 49/14* (2006.01)
*H01J 49/06* (2006.01)

(52) U.S. Cl.
CPC ..... *H01J 49/145* (2013.01); *H01J 49/067* (2013.01); *H01J 49/065* (2013.01)

(58) Field of Classification Search
CPC ..... H01J 49/065; H01J 49/067; H01J 49/145
See application file for complete search history.

(56) References Cited

U.S. PATENT DOCUMENTS 6,107,628 A * 8/2000 Smith ..... H01J 49/066 250/292
7,838,826 B1 * 11/2010 Park ..... G01N 27/623 250/281

(Continued)

FOREIGN PATENT DOCUMENTS

| | | |
|---|---|---|
| CN | 107221488 | 9/2017 |
| EP | 0198154 | 10/1986 |
| WO | WO 2009/048739 | 4/2009 |

OTHER PUBLICATIONS

A.M. Ellis, C.A. Mayhew, "Proton Transfer Reaction in Mass Spectrometry Principles and Applications", John Wiley & Sons LTd., UK, 2014 (Abstract).

(Continued)

*Primary Examiner* — David E Smith
(74) *Attorney, Agent, or Firm* — Workman Nydegger

(57) ABSTRACT

The present invention relates to a reaction chamber (12) for an IMR-MS apparatus or a PTR-MS apparatus, comprising an essentially gaslight outer housing (14), comprising at least two ion lenses (16) with essentially constant orifice dimensions and/or at least two ion lenses (17) with different orifice dimensions arranged around the reaction region (20), and at least one at least partly gaslight sealing (19), characterized in that the ion lenses (16,17) are placed inside the essentially gaslight outer housing (14), wherein between at least two adjacent ion lenses (16,17) an at least partly gaslight sealing (19) is mounted, wherein the room between at least other two ion lenses (16, 17) is such to allow a gas flow through said room from the reaction region (20) into the outer space (21). The present invention further relates to a method to operate an apparatus according to the invention.

20 Claims, 4 Drawing Sheets

(56) References Cited

U.S. PATENT DOCUMENTS

| | | | | |
|---|---|---|---|---|
| 8,698,075 | B2 * | 4/2014 | Kurulugama | H01J 49/044 250/292 |
| 9,324,548 | B1 * | 4/2016 | Benter | H01J 49/0404 |
| 9,342,548 | B2 * | 5/2016 | Neumann | G06F 16/23 |
| 9,564,305 | B2 * | 2/2017 | Berkout | H01J 49/068 |
| 2005/0092918 | A1 | 5/2005 | Smith et al. | |
| 2005/0178956 | A1 | 8/2005 | Hansel et al. | |
| 2013/0260478 | A1 * | 10/2013 | Ewing | G01N 33/0057 436/501 |
| 2014/0314660 | A1 | 10/2014 | Benter et al. | |

OTHER PUBLICATIONS

Barber et al: "Increased sensitivity in proton transfer reaction mass spectrometry by incorporation of a radio frequency ion funnel", Analytical Chemistry 84, p. 5387-5391, 2012 (Abstract).

* cited by examiner

IMR-MS REACTION CHAMBER

The present invention relates to a reaction chamber for an Ion Molecule Reaction-Mass Spectrometry (IMR-MS) apparatus or a Proton Transfer Reaction-Mass Spectrometry apparatus. The invention further relates to methods to operate such an apparatus.

BACKGROUND OF THE INVENTION

Ion Molecule Reaction-Mass Spectrometry (IMR-MS) or Proton Transfer Reaction-Mass Spectrometry (PTR-MS; both terms are used synonymously throughout this application) is a well-established method for chemical ionization, detection and quantification of (trace) compounds. Details about the technology can e.g. be found in A. M. Ellis, C. A. Mayhew (Proton Transfer Reaction Mass Spectrometry Principles and Applications, John Wiley & Sons Ltd., UK, 2014). Advantages of this technique are high sensitivity, high selectivity, on-line quantification, direct sample injection and short response times. Although most common PTR-MS instruments employ proton transfer from $H_3O^+$ to the analytes, the technology is by no means limited to this form of ionization. Several instruments have been introduced, which enable the use of $NO^+$, $O_2^+$, $Kr^+$ and any other type of positively or negatively charged reagent ions for chemical ionization. In addition to a series of common devices for controlling the various voltages, currents, temperatures, the vacuum, etc., a typical PTR-MS instrument comprises the following main components:

Ion Source:

In the ion source the reagent ions are formed. Many PTR-MS instruments employ a hollow cathode ion source fed by suitable source gases (e.g. $H_2O$ vapor, $O_2$, $N_2$, noble gases, etc.), but various other designs have been introduced (e.g. point discharge, plane electrode discharge, microwave discharge, radioactive, etc.). Favorable ion sources produce reagent ions of high purity, either because of their sophisticated design or because of the use of mass filters.

Reaction Chamber/Drift Tube:

The IMR/PTR-MS drift tube can be considered as the most critical part of a PTR-MS instrument, as chemical ionization of the analytes via interactions with the reagent ions takes place in this region. Thus, the drift tube is also referred to as reaction region or reaction chamber. While a certain flow of gas containing the analytes is continuously injected, an electric field draws ions along the drift tube. Commonly, air containing traces of impurities (e.g. traces of volatile organic compounds) is analyzed by PTR-MS, but many other matrices containing compounds of interest (e.g. remaining impurities in purified gases, gas standards, etc.) have been successfully investigated with various reagent ions. In some embodiments the matrix containing the analytes (e.g. air with traces of volatile organic compounds) is diluted with a buffer gas prior to injection into the drift tube (e.g. for simple dilution purposes, for the use of particular reagent ions or for operating particular variants of IMR-MS such as e.g. SIFDT-MS).

Some of the common reactions between the reagent ion and the analyte taking place in the drift tube are:

Proton transfer reactions, either non-dissociative or dissociative, with $A{\cdot}H^+$ being the reagent ion (in most cases $H_2O{\cdot}H^+$) and BC being the analyte:

$$A{\cdot}H^+ + BC \rightarrow A + BC{\cdot}H^+$$

$$A{\cdot}H^+ + BC \rightarrow A + B + C{\cdot}H^+$$

Charge transfer reactions, either non-dissociative or dissociative, with $A^+$ being the reagent ion (e.g. $O_2^+$, $NO^+$, $Kr^+$, etc.) and BC being the analyte:

$$A^+ + BC \rightarrow A + BC^+$$

$$A^+ + BC \rightarrow A + B + C^+$$

Clustering reactions, with $A^+$ being the reagent ion (e.g. $H_3O^+$, $NO^+$, etc.) and BC being the analyte:

$$A^+ + BC \rightarrow BC{\cdot}A^+$$

In addition other types of reactions can occur (e.g. ligand switching, $H^+$ extraction in case of negatively charged reagent ions, etc.).

Most common drift tubes consist of a series of ring electrodes electrically connected via resistors with equal resistance, so that a DC voltage U can be applied across a drift tube of the length d, resulting in the electric field strength E=U/d (in V/cm). Another important drift tube parameter is the gas number density N, which is defined by:

$$N = \frac{N_A}{V_M} \frac{273.15}{T_d} \frac{P_d}{1013.25}$$

Here, $N_A$ is the Avogadro constant ($6.022\times10^{23}$ $mol^{-1}$), $V_M$ ($22.414\times10^3$ $cm^3$ $mol^{-1}$) is the molar volume at 1013.25 hPa and at 273.15 K, $T_d$ is the temperature in K and $P_d$ is the pressure in hPa in the drift tube.

Dividing E by N leads to the reduced electric field strength, which is related to the collision energies of ion-molecule reactions in the drift tube and most commonly simply denoted as E/N with the unit Townsend (1 Td=$10^{-17}$ V $cm^2$).

Recently, novel reaction chambers, which provide improved sensitivity and/or selectivity, have been introduced. Most of these include one or more RF (radio frequency) devices, such as ion funnels (e.g. similar to U.S. Pat. No. 6,107,628) for focusing the ions and thus, avoiding losses on the walls and on the orifices to the mass analyzer.

Mass Analyzer and Detector:

Between the reaction chamber and the mass analyzer there is a transition region to account for the pressure difference between these two regions, as mass analyzers typically operate in high or ultra high vacuum regimes. Various types of mass analyzers have been employed in PTR-MS instruments. The most prominent example for a low resolution mass analyzer is the quadrupole mass filter, whereas for high mass resolution measurements Time-Of-Flight (TOF) analyzers are commonly used in PTR-MS. However, the use of other types of mass analyzers, such as e.g. ion trap analyzers, has also been reported and even MS" (multiple-stage mass spectrometry) could be realized. The mass analyzer separates the ions injected from the drift tube according to their m/z and quantifies the ion yields of the separated m/z with a suitable detector (e.g. secondary electron multiplier, microchannel plate, etc.).

The pressure within the reaction region of a PTR-MS instrument should be between 0.1 and 100 hPa. In many embodiments the pressure is between 1 and 10 hPa. Thus, the reaction chamber needs to be evacuated, in most cases by means of a vacuum pump. Two fundamentally different concepts, denoted as "concept a)" and "concept b)", of evacuating the reaction region are known from the prior art (see also section "Detailed description of the invention", FIGS. 1*a* and 1*b* and the description thereof):

Concept a) comprises an ion source, a reaction region and a mass analyzer. The reaction region comprises ion lenses (or electrodes, which is used synonymously within this application) with constant orifice diameters and ion lenses with successively decreasing orifice diameters (ion funnel). It is also possible that the reaction region consists only of ion lenses with constant orifice diameters, i.e. without an ion funnel. It is also possible that the reaction region consists of only an ion funnel. The ion lenses can be connected to DC (direct current) or RF supplies or to a combination of both, respectively.

In order to evacuate the reaction region to an appropriate pressure the ion lenses, as well as the electric/electronic elements (for DC or RF circuits) are placed in a gastight outer housing with a pumping port. Gas can freely be exchanged in both directions through the spaces between the ion lenses. That is, because although usually there are electrically insulating spacers between the ion lenses to mount them e.g. on mounting rods, the majority of the space between the electrodes is open so that gas can pass in both directions.

Barber et al. (*Increased sensitivity in proton transfer reaction mass spectrometry by incorporation of a radio frequency ion funnel*. Analytical Chemistry 84 (2012) 5387-5391) describes an instrument following this concept. This system is connected to power supplies via vacuum feed-throughs in the outer housing. The reaction chamber is pumped to about 1 hPa with a mechanical pump with max. 3 L/s pumping speed.

In contrast to this design the majority of commercial PTR-MS instruments use concept b) to evacuate the reaction chamber. The crucial difference between this concept and the above-mentioned concept a) is that no outer housing is present. Instead, gaskets between each pair of ion lenses create a gastight reaction region. Evacuation of this gastight space is performed by a vacuum pump connected to the end of the reaction chamber, pump rings, pumping ports, etc. Examples for this evacuation concept are e.g. the PTR-MS instruments from IONICON Analytik GmbH (Innsbruck, AT).

Advantages of Concept a)

It is very simple to manufacture the gastight outer housing as it is basically just a piece of metal.

The system is very robust against vibrations and mechanical shocks.

Vacuum leaks are very unlikely to appear.

Disadvantages of Concept a)

All electrical elements (connectors, soldering spots, resistors, capacitors, etc.) are inside the vacuum chamber.

There is a continuous gas exchange between the volume inside the ion lenses and outside the ion lenses.

Contaminations (originating e.g. from outgassing of the electrical elements, soldering spots, connectors, etc.) can diffuse into the volume inside the ion lenses, where they can get ionized by the reagent ions and eventually detected by the mass analyzer.

Thus, even if purified air is sampled there is a considerable chemical background which jeopardizes the limits-of-detection.

The higher the sensitivity of the instrument, the stronger this effect becomes, because even minor trace contaminations of the reaction region are detected.

Advantages of Concept b)

All electric elements (connectors, soldering spots, resistors, capacitors, etc.) are outside the vacuum region If the reaction chamber is absolutely gastight no contaminations can diffuse into the reaction region The chemical background is extremely low (limited to the outgassing of the ion lens and gasket material)

Better limits-of-detection can be achieved than with concept a) which is most probably the reason why concept b) is used in most commercial instruments Disadvantages of Concept b)

The manufacturing of an absolutely gastight reaction chamber according to this concept is (mechanically) challenging Vacuum leaks are rather likely to appear Thermal changes, vibrations and mechanical shocks can induce vacuum leaks Minor vacuum leaks may stay undetected, but cause an elevated chemical background In the prior art also the evacuation of ion funnels is described. U.S. Pat. No. 9,564,305 discloses an ion funnel with gastight spacing between the electrodes to create an axial gas dynamic flow at the outlet of the ion funnel for improved transmission of low m/z ions. U.S. Pat. No. 8,698,075 discloses an ion funnel for orthogonal ion injection and a strong directional gas flow through an opening on the opposite side for the removal of liquid droplets created by the ionization. Air and liquid droplets can also be removed from the ion guide by passing through the spacing between the electrodes.

Moreover, in U.S. Pat. No. 9,324,548 B1 a reaction chamber including metallic electrode rings with ceramic distance pieces as insulating material between them, which are arranged in a tube, and an adjacent ion funnel is disclosed. A similar reaction chamber is also disclosed in US 2014/314660 A1. In both cases there is a large distance, especially in comparison to the orifice diameter of the electrode rings, between the tube and the ion funnel. Thus, the neutral gas is immediately removed at the transition of the tube to the ion funnel and contaminations can easily enter the inner region of the ion funnel.

All of the above stated concepts cannot be used in an IMR/PTR-MS instrument and do not solve the abovementioned problems, because in an IMR/PTR-MS instrument as described above the speed of the neutrals (i.e. gas flow) must be considerably lower than the speed of the ions, as the reaction chamber is a drift tube rather than a flow tube. Furthermore, no liquid droplets are injected into the reaction chamber, but the "contaminations" injected into the reaction region are the analytes that need to be analyzed.

BRIEF DESCRIPTION OF THE INVENTION

The object of the present invention is thus to provide a novel IMR/PTR-MS reaction chamber which combines the advantages of current concepts while eliminating the disadvantages and also lowering the limits-of-detection as well as enhancing validity of IMR/PTR-MS measurements.

This goal is achieved by providing a reaction chamber for an Ion Molecule Reaction-Mass Spectrometry (IMR-MS) apparatus or a Proton Transfer Reaction-Mass Spectrometry apparatus, comprising at least one essentially gastight outer housing defining an outer space and having at least one pumping port, a sample gas inlet, an injection port for ions connectable with an ion source, an exit connectable with a mass analyzer, a reaction region between the inlet for ions and the exit, at least three ion lenses with essentially constant orifice dimensions arranged around the reaction region and/or at least three ion lenses with different orifice dimensions arranged around the reaction region, and at least one at least partly gastight sealing, wherein the sample gas inlet is preferably placed upstream to the ion lenses, wherein the outer space comprises the space between the reaction region and the essentially gastight outer housing, characterized in that the ion lenses are placed inside the essentially gastight outer housing, wherein between at least two adjacent ion lenses an at least partly gastight sealing is mounted, wherein the room between at least other two ion lenses is configured to allow a gas flow out of the reaction region through said room into the space between the outside of the reaction region and the outer space, wherein the distance between adjacent ion lenses is either the same as or smaller than the distance between the at least two adjacent ion lenses with an at least partly gastight sealing between them.

"At least partly gastight sealing" here means that the sealing not necessarily needs to be completely free of any gas leaks, as the purpose of the sealing is to generate a (rather small) pressure gradient between the inner space (the space surrounded by the orifices and forming the reaction region) and the outer space (the space surrounding the orifices and reaction region). In all cases, where an at least partly gastight sealing is used, the at least partly gastight sealing fills all the space between two adjacent ion lenses.

In an embodiment, between at least two adjacent ion lenses with essentially constant orifice dimensions an at least partly gastight sealing is mounted.

In another embodiment between at least two adjacent ion lenses with different orifice dimensions an at least partly gastight sealing is mounted.

In all embodiments the at least one at least partly gastight sealing separates the reaction chamber into a reaction region and a space between the outside of the reaction region and the outer housing, wherein the dimension of the reaction region in a certain area essentially equals the orifice dimension of a respective ion lens in said area.

In a preferred embodiment the reaction region comprises two regions with ion lenses, wherein the first region comprises adjacent ion lenses with gastight sealing and the second region comprises adjacent ion lenses without gastight sealing. The term "without gastight sealing" in the sense of the invention refers to two adjacent ion lenses comprising no sealing between them, i.e. there is a free space between the ion lenses.

Preferably, the length of the first region is equal to or larger than the length of the second region. More preferably the length of the first region is at most twice the length of the second region.

In one embodiment between at least two adjacent ion lenses with essentially constant orifice dimensions no at least partly gastight sealing is mounted.

Preferably, in gas flow direction (in the direction of central axis or longitudinal axes of the reaction region, i.e. from the ion source to the mass analyzer) the first region consists of ion lenses with essentially constant orifice dimensions and/or with different orifice dimension.

In a preferred embodiment the region consisting of adjacent ion lenses with gastight sealings is in the vicinity of the injection port for ions and region consisting of adjacent ion lenses without gastight sealings is adjacent to the exit.

The reaction chamber is further characterized in that during operation neutral sample gas is quasi-stationary, whereas ionized gas is accelerated by the ion lenses to the exit.

The advantage of such a configuration is that neutral (not ionized) gas can get out of the reaction region into the space between outside the reaction region and the outer housing due to pressure gradients inside the reaction chamber. On the other hand, neutral gas from the space between outside of the reaction region and the outer housing cannot enter the reaction region. This leads to reduction of the chemical background.

For similar reasons, it is also conceivable that either between at least two adjacent ion lenses with different orifice dimensions or between all adjacent ion lenses with different orifice dimensions, i.e. the ion funnel, no at least partly gastight sealing is mounted. In this embodiment it is conceivable, that between all adjacent ion lenses with essentially constant orifice dimensions an at least partly gastight sealing is mounted.

In another embodiment, between at least two adjacent ion lenses with essentially constant orifice dimensions no at least partly gastight sealing is mounted.

Independent of the exact configuration of the sealings, the ion lenses with different orifice dimensions are preferably downstream to the ion lenses with essentially constant orifice dimensions, wherein the ion lenses with different orifice dimensions act as an ion funnel.

Preferably, the distance between two adjacent ion lenses of the ion funnel is less than the distance between two adjacent ion lenses with essentially constant orifice dimensions.

The ion lenses can be made of any appropriate conductive material, like e.g. stainless steel. In a preferred embodiment the ion lenses are passivated.

Another aspect of the invention is to use a reaction chamber according to the invention in an Ion Molecule Reaction-Mass Spectrometry and/or Proton Transfer Reaction-Mass Spectrometry apparatus, comprising at least one ion source producing a specific type of reagent ions at a purity level of preferably more than 95%, at least one reaction chamber according to the invention and a mass analyzer. This configuration leads to enhancement of performance, due to a reduced chemical background.

Such an apparatus can be characterized in that a first reaction chamber according to the invention is placed downstream to the ion source and a second reaction chamber is placed downstream to the first reaction chamber.

In a preferred embodiment, the second reaction chamber comprises at least one gas inlet, with which a gas containing analytes is introducible.

In a special embodiment, the at least one gas inlet of the second reaction chamber is interconnected with an at least one gas inlet in the area of the first reaction chamber, the said area being preferably between the ion source and the first reaction chamber. Into both, the first and second reaction chamber, a gas containing analytes is introducible.

Another embodiment intends that the second reaction chamber can be operated as an Ion-Mobility-Spectrometer. In this case, an inert carrier gas, e.g. $N_2$, Ar, He, purified air, etc. is introducible into the first reaction chamber and/or the second reaction chamber according to the invention.

A further aspect of the present invention relates to a method for operating an apparatus according to the invention, wherein a gas containing analytes is introduced into the first reaction chamber via a gas inlet, wherein a gas containing analytes is introduced into the second reaction chamber via a gas inlet, wherein the first and the second reaction chambers both are operated as a drift tube. Especially, the reaction region of the first and the second reaction chambers are operated as a drift tube.

In the context of this description of the invention, a drift tube refers to an IMR/PTR-MS reaction region, where chemical ionization reactions between the reagent ions and the analytes take place. In the special case, where the second reaction chamber acts as an Ion-Mobility-Spectrometer, the reaction region does not act as a drift tube in the common sense, i.e. essentially no chemical ionization reaction between the reagent ions and the inert gas introduced into the second reaction chamber takes place, but the ions introduced from the first reaction chamber are separated according to their mobility in the inert gas.

In another mode to operate an apparatus according to the invention, a gas containing analytes is introduced into the first reaction chamber via an gas inlet, wherein an inert gas is introduced into the second reaction chamber via a gas inlet, wherein the first reaction chamber, especially the reaction region, acts as a drift tube and the second reaction chamber acts as an Ion-Mobility-Spectrometer.

The gas containing analytes (sample gas) can be introduced into the first and the second reaction chamber. This leads to the duplication of the interaction length and consequently enhances the sensitivity of the apparatus. In the case where the sample gas is introduced into the first reaction chamber and where an inert gas is introduced into the second reaction chamber downstream the first reaction chamber, wherein both reaction chambers act as a drift tube, the second reaction chamber transports the ions towards the mass analyzer. In another case, the sample gas and the inert gas are introduced like described in the latter case, but the second reaction chamber acts as an Ion-Mobility-Spectrometer, which leads to an enhancement of the selectivity by separating the ions according to their mobility.

Further embodiments and advantages of the invention are explained by reference to the figures.

SHORT DESCRIPTION OF THE FIGURES

FIG. 1*a*, 1*b* shows two configurations of conventional IMR/PTR-MS instruments according to the state of the art. FIG. 1*a* shows a gastight outer housing and FIG. 1*b* shows gastight sealings between the electrodes.

Figure 6:
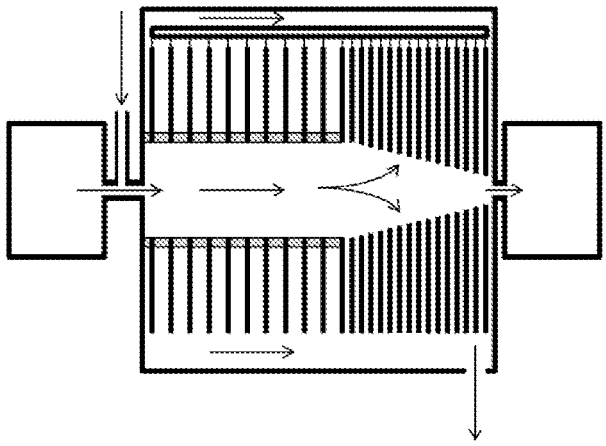

FIG. 6 schematically shows the typical flow of neutral (not ionized) gas in an exemplary embodiment of the present invention.

Figure 7:
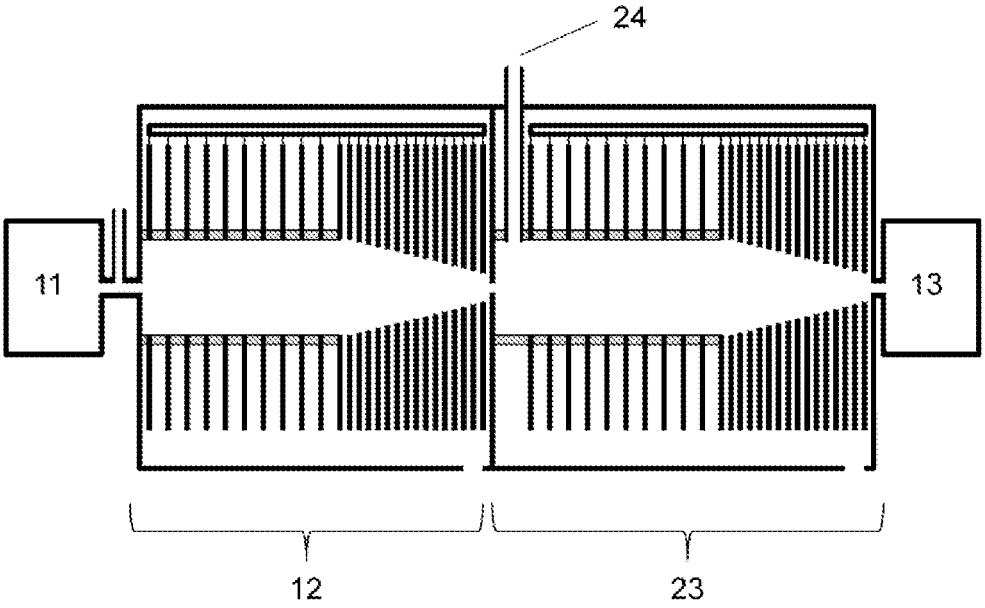

FIG. 7 shows an exemplary embodiment of the present invention with more than one reaction chambers.

DETAILED DESCRIPTION OF THE INVENTION

Figure 1A:
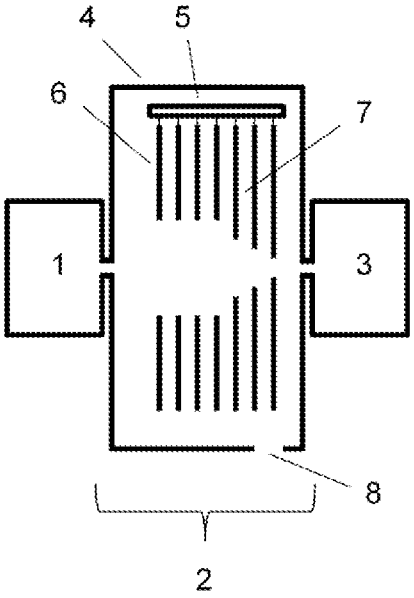
Figure 1B:
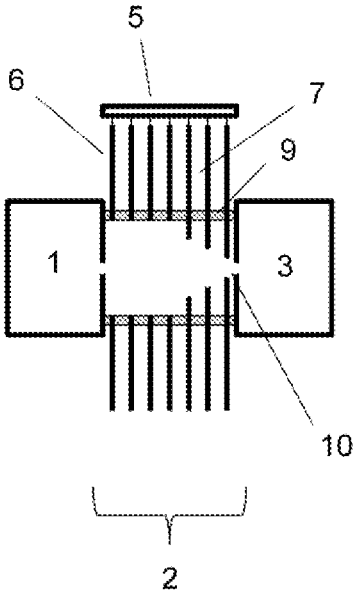
Fig. 1b Prior art

Two different concepts of evacuating the reaction region according to the state of the art are schematically shown in FIGS. 1*a* and 1*b*, respectively.

Concept a) of FIG. 1*a* comprises an ion source 1, a reaction region 2 and a mass analyzer 3. The reaction region 2 comprises at least two ion lenses (or electrodes, which is used synonymously within the entire description) 6 with constant orifice diameters and at least two ion lenses 7 with successively decreasing orifice diameters (ion funnel). It is also possible that the reaction region consists only of ion lenses 6 with constant orifice diameters, i.e. without an ion funnel. It is also possible that the reaction region consists only of ion lenses 7 with successively decreasing orifice diameters, i.e. only an ion funnel. The ion lenses 6 and 7 can be connected to DC (direct current) or RF supplies or to a combination of both, respectively. In order to supply the voltages to the ion lenses 6 and/or 7 they have to be electrically contacted and connected. In the simple case of only constant orifice diameter ring electrodes 6, which are operated in DC mode, a resistor chain can be connected to all of the ring electrodes, whereas the first and the last electrode is connected to the DC power supply. In the more complex case of the ion lenses 6 and 7 being operated with DC and RF, (i.e. as RF electrodes and ion funnel) the electrical contacting can comprise resistors, capacitors, integrated circuits or any other suitable elements 5. In order to evacuate the reaction region to an appropriate pressure the ion lenses 6 and/or 7, as well as the electric/electronic elements 5 are placed in a gastight outer housing 4 with a pumping port 8. Gas can freely be exchanged in both directions through the spaces between the ion lenses. That is, because although usually there are electrically insulating spacers between the ion lenses to mount them e.g. on mounting rods, the majority of the space between the electrodes is open so that gas can pass in both directions.

In contrast to this design the majority of commercial PTR-MS instruments use concept b) of FIG. 1*b* to evacuate the reaction chamber. The crucial difference between this concept and the above-mentioned concept a) is, that no outer housing 4 is present. Instead, gaskets 9 between each pair of ion lenses create a gastight reaction region. Evacuation of this gastight space is performed by a vacuum pump connected to the end of the reaction chamber, pump rings, pumping ports, etc. 10.

In the following the current invention is explained in detail. Reference signs refer to FIG. 2 to FIG. 5, which comprise basically the same components in different configurations.

The reaction chamber according to the invention comprises a series of electrodes (ion lenses) with constant orifice dimensions (diameters in case of ring electrodes) 16 and an adjacent ion funnel, consisting of a series of electrodes (ion lenses) with successively decreasing orifice dimensions (diameters in case of ring electrodes) 17, which are placed inside a gastight outer housing 14 and where between at least two adjacent electrodes an at least partly gastight sealing 19 is mounted.

Preferably, the at least partly gastight sealing is mounted between at least the first two electrodes (counted from the ion source 11) and there is an at least partly gastight sealing between the injection port from the ion source 11 and sample gas inlet 22 and the first electrode. Reagent ions, which are produced in a reagent ion source 11 and the gas containing the analyte are injected into the reaction region 20. The outer housing 14 is evacuated by a vacuum pump via a pump port 18. Any vacuum pump that has a sufficient pumping power is possible (membrane pump, scroll pump, multi-stage turbomolecular pump, etc.). A valve can be installed between the pump port 18 and the vacuum pump to control the pumping power and speed.

Because of the at least partly gastight sealing between at least two electrodes, there is a pressure gradient between the reaction region 20 and the space 21 between the outside of the reaction region 20 and the outer housing 14. This pressure gradient will prevent contaminations originating from outside the reaction region 20 (e.g. from electric elements 15 (connectors, soldering spots, resistors, capacitors, etc.)) from entering the reaction region 20. This results in a low chemical background and eventually in an improved limit of detection compared to designs known in the art. Subsequently, the ions (reagent and product ions) are transferred into a mass analyzer 13.

In some embodiments there are at least three ring electrodes with constant orifice diameters 16 and no ion funnel 17 with at least one at least partly gastight sealing 19 between two adjacent ring electrodes. Preferably, this at least one at least partly gastight sealing is between the first two ring electrodes and there is an at least partly gastight sealing between the injection port from the ion source 11 and sample gas inlet 22 and the first electrode.

In some embodiments there are at least three ion funnel electrodes with successively decreasing orifice diameters 17 and no ring electrodes with constant orifice diameters 16 with at least one at least partly gastight sealing 19 between two adjacent ion funnel electrodes. Preferably, this at least one at least partly gastight sealing is between the first two ion funnel electrodes and there is an at least partly gastight sealing between the injection port from the ion source 11 and sample gas inlet 22 and the first electrode.

In a preferred embodiment there are at least three ring electrodes with constant orifice diameters 16 and at least two ion funnel electrodes with successively decreasing orifice diameters 17. The at least one at least partly gastight sealing 19 is placed between the first two ring electrodes with constant orifice diameters 16 and there is an at least partly gastight sealing between the injection port from the ion source 11 and sample gas inlet 22 and the first electrode.

The at least partly gastight sealing 19 may be a gasket made of PTFE (polytetrafluoroethylene), PEEK (polyether ether ketone), any thermoplastic polymer, any fluoropolymer elastomer, synthetic rubber, ceramics or any other material suitable for creating an at least partly gastight sealing between two electrodes while electrically insulating the two electrodes.

The electrodes (ion lenses) can be made of any appropriate conductive material, like e.g. stainless steel. In a preferred embodiment the electrodes are passivated. Various methods for passivation are known in the art, such as e.g. inert silicon coatings (trademarks are e.g. Silcosteel, Sulfinert, etc. from Restek Corporation US). The advantage of using passivated material in an IMR/PTR-MS reaction chamber is that compounds are less likely to adhere ("stick"). This improves response and decay times and suppresses memory effects.

Some embodiments may use electrodes 16, 17 with shapes different to a ring and a circular orifice. These could be triangular, rectangular, polygon, oval, etc. orifices and any outer shapes.

Figure 2:
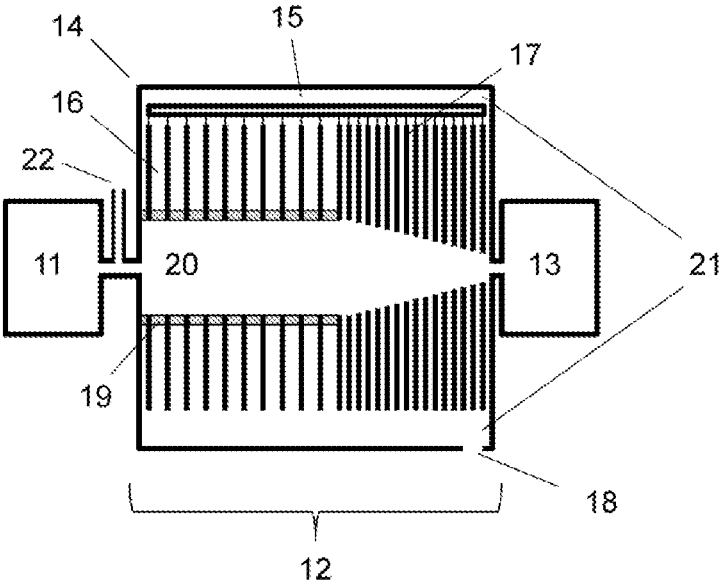
FIG. 2 shows an exemplary embodiment of the present invention where the electrodes with constant orifice dimensions (diameters in case of circular orifices) are sealed at least partially gastight and the ion funnel is not sealed.

In a preferred embodiment there are at least ten ring electrodes with constant orifice diameters 16 and at least five ion funnel electrodes 17. The at least partly gastight sealings are between all of the ring electrodes with constant orifices 16 and there is an at least partly gastight sealing between the injection port from the ion source 11 and sample gas inlet 22 and the first electrode, while there are no sealings between the ion funnel electrodes 17. This embodiment is schematically shown in FIG. 2.

Figure 3:
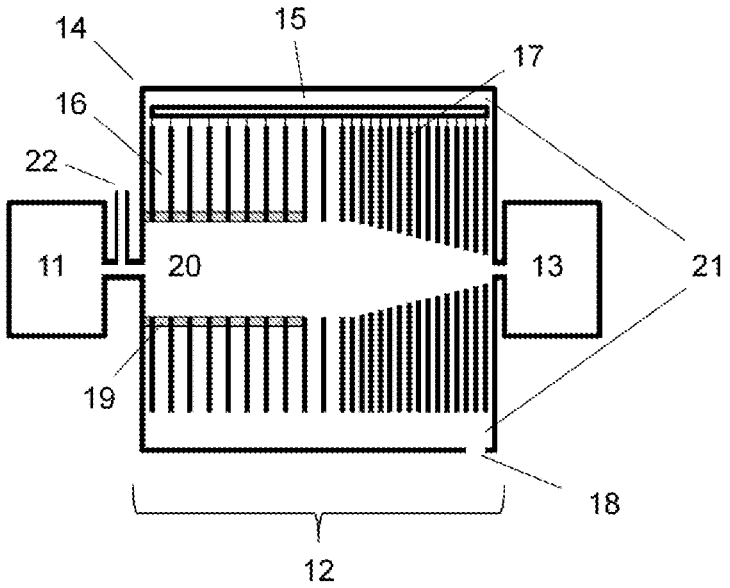
FIG. 3 shows an exemplary embodiment of the present invention where only part of the electrodes with constant orifice dimensions are sealed at least partially gastight and the ion funnel is not sealed.

In a similar embodiment more than the first 50% but not all of the spaces between the ring electrodes with constant orifice diameters 16 are at least partly gastight sealed. This embodiment is schematically shown in FIG. 3.

Figure 4:
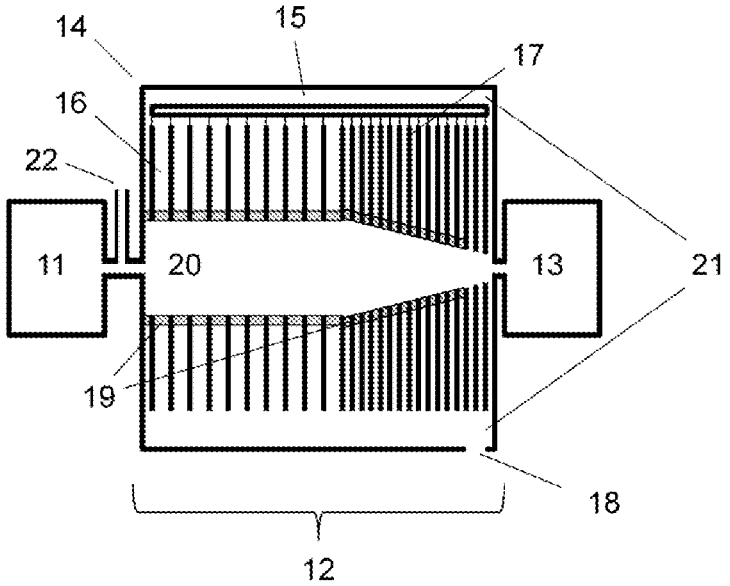
FIG. 4 shows an exemplary embodiment of the present invention where the electrodes with constant orifice dimensions and part of the ion funnel are sealed at least partially gastight and part of the ion funnel is not sealed.
Figure 5:
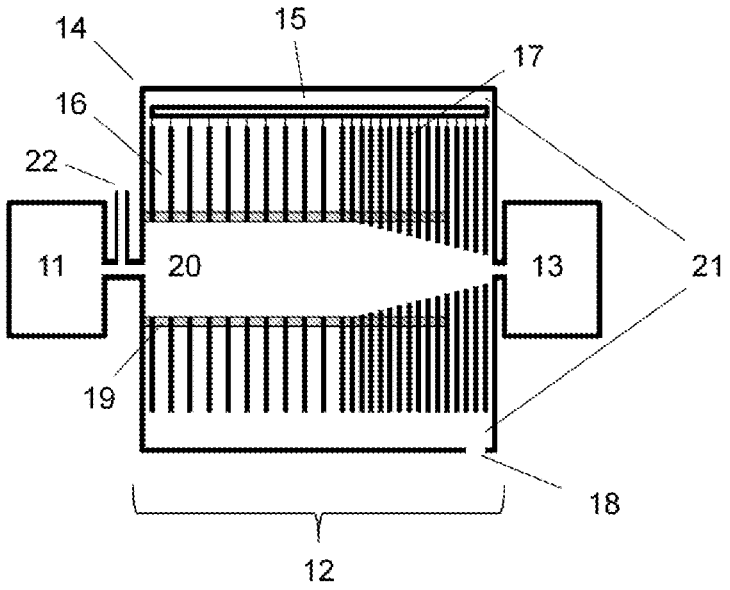
FIG. 5 shows an exemplary embodiment of the present invention where the electrodes with constant orifice dimensions and part of the ion funnel are sealed at least partially gastight and part of the ion funnel is not sealed, with the seals of the ion funnel being at a different position compared to FIG. 4.

In another embodiment all spaces between the ring electrodes with constant orifice diameters 16 and at least two of the spaces between the ion funnel electrodes 17 are at least partly gastight sealed. This embodiment is schematically shown in FIG. 4 and FIG. 5.

Typical gas flows injected into the reaction region 20 are between 1 and 1000 sccm (standard $cm^3$ per min), preferably between 20 and 300 sccm. Typical pressures inside the reaction region 20 are between 0.1 and 100 hPa, preferably between 1 and 10 hPa.

The speed of motion of the ions in axial direction (i.e. from left to right in the figures) in the reaction region 20 must be considerably higher than the speed of motion of neutrals in axial direction. Preferably, the speed of the ions is 1 to 3 orders of magnitude higher than the speed of neutrals. That is, the neutral gas can be seen as quasi-stationary compared to the ions. In other words, the axial motion of particles caused by the gas flow must be considerably slower than the axial motion caused by electric fields.

FIG. 6 schematically shows the flow of neutral gas in an exemplary embodiment with the gas entering from the sample gas inlet and the ion source through the at least partially gastight section of the reaction region, exiting through the non-sealed section of the ion funnel into the vacuum pump. Contaminations originating from e.g. the electric/electronic elements are pumped directly into the vacuum pump without the possibility to enter the reaction region. It should be noted that part of the neutral gas enters the transfer region to the mass analyzer because of the lower pressure there. This part is relatively small because of limiting apertures.

Example

The present example consists of a reagent ion source 11 producing $H_3O^+$ reagent ions at a high purity of >95%. The air to be analyzed is drawn in via a sample inlet 22 and mixed with the reagent ions. This flow of about 50 sccm is drawn into a reaction chamber 12, which is similar to the one schematically displayed in FIG. 2.

Adjacent to the entrance port of the reagent ions and the gas containing the analytes, 24 stainless steel ring electrodes 16 with constant orifice diameters of 10 mm and 0.5 mm thickness are mounted. The length of this stack of ring electrodes is 6.1 cm. Between each pair of electrodes and between the injection port from the ion source 11 and sample gas inlet 22 and the first electrode are electrically insulating gastight PTFE gaskets (2.04 mm thickness).

Adjacent to the ring electrodes with constant orifice diameters, 20 stainless steel ring electrodes (0.5 mm thickness) with successively decreasing orifice diameters 17 (from 10 mm to 1 mm orifice diameter) are mounted, which act as an ion funnel. The length of the ion funnel is 2.6 cm. The ring electrodes of the ion funnel are separated with spacers (0.8 mm) which only provide electrical insulation but enable gas to escape between the electrodes. Each ring electrode 16, 17 is connected with electrically conducting pins to a board 15 comprising resistors and capacitors. The board 15 is connected to external RF and DC supplies via vacuum feedthroughs. The whole stack of ring electrodes 16, 17, as well as the board 15, are surrounded by a gastight outer housing 14. The gastight outer housing 14 has a pumping port 18 which is connected to a vacuum pump. A valve between the pumping port 18 and the vacuum pump allows for regulating the pumping speed. The pressure in the space outside of the ring electrodes 21 is monitored with a pressure gauge and kept between 2-4 hPa. Because of the gastight gaskets between ring electrodes 16 there is a pressure gradient of some $10^{-1}$ hPa (more specifically 0.2-0.3 hPa) between the space inside 20 and outside 21 of the ring electrodes.

This pressure gradient causes a gas flow from the inside 20 to the outside 21 of the electrodes via the open spaces between the ion funnel electrodes and effectively prevents contaminations originating e.g. from the board 15 from entering the reaction region 20. That is, the gas containing the analytes flows in axial direction through the gastight section of electrodes 16 and exits via the open spaces between the ring electrodes 17 into space 21 where it is eventually pumped away via pumping port 18. The time neutral compounds within the gas to be analyzed need to travel from entering the reaction region 20 to exiting the reaction region can be calculated to about 50 ms. The reagent and product ions on the other hand are confined within the ring electrodes 16, 17 by applied RF voltages and accelerated in direction of the adjacent mass analyzer 13 by DC fields. If RF and DC voltages are applied so that the reduced electric field strength in the reaction region is comparable to about 130 Td the time the ions need to travel through the reaction region 20 and into the mass analyzer 13 is about 500 μs. Therefore, the neutral gas can be seen as quasi-stationary compared to the motion of the ions, as the speed of the ions is two orders of magnitude higher than the speed of the neutrals. Moreover, no or only negligible ion transport is caused by the gas flow.

For this exemplary embodiment the RF frequency applied to electrodes 16, 17 was 1 MHz. 0.1-10 MHz are possible, whereas 0.5-2 MHz is the preferred frequency region. The RF amplitude $V_{pp}$ was 300 V, while voltages between 50 and 1000 V, preferably between 100 and 500 V are possible. The DC voltage applied across the stack of electrodes 16 was 80 V and across the ion funnel 17 20 V. DC voltages between 5 and 1000 V are possible, respectively.

It is possible to employ more than one of the reaction chambers designed according to the present invention in one instrument. An embodiment with two reaction chambers is shown in FIG. 7. In this exemplary embodiment two nearly identical reaction chambers are connected in series between the ion source 11 and the mass analyzer 13. However, the difference between the first and second reaction chamber is the gas inlet 24 in the second reaction chamber 23. This gas inlet 24 can e.g. be interconnected with gas inlet 22 so that the same gas containing the analytes is present in both reaction chambers 12 and 23 and the reaction region is doubled which will also double the sensitivity of the PTR-MS instrument.

In a preferred embodiment gas inlet 24 is used to supply an inert carrier gas, for example but not limited to $N_2$, Ar, He, purified air, etc. In this configuration the second reaction chamber 23 simply acts as an additional ion focusing element and has limited influence on the instrument's sensitivity. However, it is possible to operate the second reaction chamber in a way so that Ion-Mobility Spectrometry (IMS) can be performed.

In this IMS mode of operation the ions from reaction chamber 12 are introduced into reaction chamber 23 in packages rather than continuously. This can be achieved e.g. by a gating electrode at the beginning of reaction chamber 23, but also other gating or pulsing measures are possible. Depending on their mobility in the carrier gas different types of ions will need different times to travel through reaction chamber 23 and thus arrive at different times at the mass analyzer 13. Again, as in reaction chamber 12 also the gas flow in reaction chamber 23 is chosen to be quasi-stationary compared to the speed of the ions (driven by voltages applied to the electrodes). The pressure gradient between the inner and outer space of the ring electrodes, caused by at least partly gastight sealings 19 between pairs of electrodes according to the present invention, prevents contaminations from entering the reaction (or in this case strictly speaking IMS) region.

Operating the second reaction chamber 23 as an IMS device considerably increases the instrument's selectivity by adding another data dimension. Conventional PTR-MS instruments offer the following selectivity dimensions: m/z of the ions measured with the mass analyzer 13 (including fragment ions and isotope distributions), effects of changing the ion chemistry by changing the E/N and effects of changing the ion chemistry by switching the reagent ions. Adding an IMS device will additionally separate the ions according to their mobility and in sum enable nearly unambiguous identification.

It is possible to operate reaction chamber 23 only at certain times as an IMS device. That is, in "normal" operation mode the instrument is used as a conventional PTR-MS instrument, i.e. with the second reaction chamber 23 being operated in continuous mode. Only in cases where additional selectivity is needed (e.g. to separate isomers or isobars for which the mass resolution of the mass analyzer is insufficient to separate them) the second reaction chamber 23 is switched to IMS mode, i.e. is operated in pulsed mode.

Obviously, in general it is possible to place the sample inlet line 22 in reaction chamber 12 at the position of the inlet line 24 in reaction chamber 23, i.e. directly into the reaction region instead of introducing a mixture of reagent ions and gas containing the analytes into the reaction region. This is possible for a PTR-MS instrument with one reaction chamber 12 and for instruments with more than one reaction chambers, e.g. with a second reaction chamber 23, which can be operated as an IMS device.

The main advantage of the current invention is, that it enables the construction of an IMR/PTR-MS reaction chamber with an extremely pure reaction region. This is achieved by an innovative design which prevents contaminations from entering the reaction region while being easy to manufacture and unsusceptible to gas leakage. Moreover, the sealings between pairs of electrodes inside the reaction chamber only need to be at least partially gastight as their purpose is to create a small pressure gradient and not a completely gastight regime, which is e.g. needed for existing designs where the electrodes have to be sealed completely gastight against atmospheric pressure. The gas flow within the reaction region is quasi-stationary compared to the motion of the ions and thus, the ions are virtually not affected by the gas flow. The invention is particularly beneficial for very high sensitivity IMR/PTR-MS instruments as the low chemical background resulting from the invention will allow for extraordinary low limits of detection.

The invention claimed is:

1. A reaction chamber for an Ion Molecule Reaction-Mass Spectrometry (IMR-MS) apparatus or a Proton Transfer Reaction-Mass Spectrometry apparatus, comprising at least one essentially gastight outer housing defining an outer space, at least one pumping port, a sample gas inlet, an injection port for ions connectable with an ion source,
an exit connectable with a mass analyzer,
a reaction region between the injection port for ions and the exit,
at least three ion lenses with essentially constant orifice dimensions arranged around the reaction region and/or at least three ion lenses with different orifice dimensions arranged around the reaction region, and
at least one at least partly gastight sealing,
wherein the outer space comprises the space between the reaction region and the essentially gastight outer housing,
wherein the ion lenses are placed inside the essentially gastight outer housing, wherein between at least two adjacent ion lenses the at least one at least partly gastight sealing is mounted, wherein the room between at least other two ion lenses is such to allow a gas flow through said room from the reaction region into the outer space,
wherein for all ion lenses the distance between adjacent ion lenses is either the same as or smaller than the distance between the at least two adjacent ion lenses with the at least one at least partly gastight sealing between them.

2. The reaction chamber according to claim 1, wherein between at least two adjacent ion lenses with essentially constant orifice dimensions the at least one at least partly gastight sealing is mounted.

3. The reaction chamber according to claim 1, wherein between at least two adjacent ion lenses with different orifice dimensions the at least one at least partly gastight sealing is mounted.

4. The reaction chamber according to claim 1, wherein between at least two adjacent ion lenses with different orifice dimensions no at least partly gastight sealing is mounted.

5. The reaction chamber according to claim 4, wherein between at least two adjacent ion lenses with essentially constant orifice dimensions no at least partly gastight sealing is mounted.

6. The reaction chamber according to claim 1, wherein during operation the speed of motion of the ions is at least one order of magnitude higher than the speed of motion of the neutral sample gas, whereas the ions are accelerated by the ion lenses to the exit.

7. The reaction chamber according to claim 6, wherein the reaction region comprises two regions with ion lenses, wherein the first region comprises adjacent ion lenses with at least one at least partly gastight sealing and wherein the second region comprises adjacent lenses without at least one at least partly gastight sealing.

8. The reaction chamber according to claim 1, wherein the at least one at least partly gastight sealing separates the reaction chamber into the reaction region and the outer space between the outside of the reaction region and the outer housing, wherein the dimension of the reaction region in a region around one ion lens essentially equals the orifice dimension of the respective ion lens in this region.

9. An Ion Molecule Reaction-Mass Spectrometry (IMR-MS) and/or Proton Transfer Reaction-Mass Spectrometry apparatus, comprising at least one ion source producing a specific type of reagent ions at a purity level of more than 95%, at least one reaction chamber and a mass analyzer, wherein the at least one reaction chamber is according to claim 1.

10. The apparatus according to claim 9, wherein a first reaction chamber is placed downstream to the ion source and a second reaction chamber is placed downstream to the first reaction chamber.

11. The apparatus according to claim 10, wherein the sample gas inlet of the second reaction chamber is interconnected with the sample gas inlet in the area of the first reaction chamber.

12. The apparatus according to claim 10, wherein the second reaction chamber can be operated as an Ion-Mobility-Spectrometer.

13. A method to operate an apparatus according to claim 10, wherein a gas containing analytes is introduced into the first reaction chamber via the sample gas inlet of the first reaction chamber, wherein the gas containing analytes is introduced into the second reaction chamber via the sample gas inlet of the second reaction chamber, wherein the first and the second reaction chambers both act as an IMR/PTR-MS drift tube.

14. A method to operate an apparatus according to claim 12, wherein a gas containing analytes is introduced into the first reaction chamber via the sample gas inlet of the first reaction chamber, wherein an inert gas is introduced into the second reaction chamber via the sample gas inlet of the second reaction chamber, wherein the first reaction chamber acts as an IMR/PTR-MS drift tube and the second reaction chamber acts as an Ion-Mobility-Spectrometer.

15. A method to operate an apparatus according to claim 9, wherein the sample gas, which enters the at least one reaction chamber through the sample gas inlet, leaves the reaction region of the at least one reaction chamber through the room between at least two ion lenses into the outer space, wherein the sample gas is removed from the outer space, wherein contaminations in the outer space cannot enter the reaction region through the room between at least two ion lenses because of a pressure gradient.

16. The reaction chamber according to claim 1, wherein the sample gas inlet is placed upstream to the ion lenses.

17. The reaction chamber according to claim 1, wherein the ion lenses are arranged so as to create a pressure gradient between the reaction region and the outer space so that contaminations in the outer space do not enter the reaction region through the room between at least two ion lenses.

18. A reaction chamber for an Ion Molecule Reaction-Mass Spectrometry (IMR-MS) apparatus or a Proton Transfer Reaction-Mass Spectrometry apparatus, comprising
at least one essentially gastight outer housing defining an outer space,
at least one pumping port,
a sample gas inlet,
an injection port for ions connectable with an ion source,
an exit connectable with a mass analyzer,
a reaction region between the injection port for ions and the exit,
at least three ion lenses with essentially constant orifice dimensions arranged around the reaction region and/or at least three ion lenses with different orifice dimensions arranged around the reaction region, and
at least one at least partly gastight sealing,
wherein the outer space comprises the space between the reaction region and the essentially gastight outer housing,
wherein the ion lenses are placed inside the essentially gastight outer housing, wherein between a first plurality of adjacent ion lenses the at least one at least partly gastight sealing is mounted, wherein the room between a second plurality of adjacent ion lenses is such to allow a gas flow through said room from the reaction region into the outer space, wherein a distance between a last ion lens of the first plurality of adjacent ion lenses adjacent to a first ion lens of the second plurality of adjacent lenses is either the same as or less than the distance between at least two adjacent lenses of the first plurality of adjacent ion lenses.

19. The reaction chamber according to claim 18, wherein the ion lenses are arranged so as to create a pressure gradient between the reaction region and the outer space so that contaminations in the outer space do not enter the reaction region through the room between at least two ion lenses.

20. A reaction chamber for an Ion Molecule Reaction-Mass Spectrometry (IMR-MS) apparatus or a Proton Transfer Reaction-Mass Spectrometry apparatus, comprising at least one essentially gastight outer housing defining an outer space, at least one pumping port, a sample gas inlet, an injection port for ions connectable with an ion source, an exit connectable with a mass analyzer, a reaction region between the injection port for ions and the exit, at least three ion lenses with essentially constant orifice dimensions arranged around the reaction region and/or at least three ion lenses with different orifice dimensions arranged around the reaction region, and at least one at least partly gastight sealing, wherein the outer space comprises the space between the reaction region and the essentially gastight outer housing, wherein the ion lenses are placed inside the essentially gastight outer housing, wherein between a first plurality of adjacent ion lenses the at least one at least partly gastight sealing is mounted, wherein the room between a second plurality of adjacent ion lenses is such to allow a gas flow through said room from the reaction region into the outer space, wherein the maximum orifice dimension of each of the second plurality of ion lenses is equal to or less than the orifice dimension of each of the first plurality of adjacent ion lenses.

* * * * *